US009505520B2

(12) United States Patent
Baker

(10) Patent No.: US 9,505,520 B2
(45) Date of Patent: Nov. 29, 2016

(54) SLIDE AND POUR CONTAINER

(71) Applicant: WestRock Shared Services, LLC, Norcross, GA (US)

(72) Inventor: Michael A. Baker, Downers Grove, IL (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 14/723,017

(22) Filed: May 27, 2015

(65) Prior Publication Data

US 2015/0344172 A1 Dec. 3, 2015

Related U.S. Application Data

(60) Provisional application No. 62/003,630, filed on May 28, 2014.

(51) Int. Cl.

| | |
|---|---|
| ***B65D 5/72*** | (2006.01) |
| ***B31B 3/26*** | (2006.01) |
| ***B65D 5/74*** | (2006.01) |
| ***B65D 5/02*** | (2006.01) |
| ***B65D 5/54*** | (2006.01) |

(52) U.S. Cl.

CPC ..... *B65D 5/723* (2013.01); *B31B 3/26* (2013.01); *B65D 5/0227* (2013.01); *B65D 5/541* (2013.01); *B65D 5/742* (2013.01)

(58) Field of Classification Search

CPC .... B65D 5/723; B65D 5/0227; B65D 5/541; B65D 5/742; B65D 5/72; B65D 5/74; B65D 5/701; B65D 5/705; B31B 3/26

USPC ..... 229/208; D9/438

See application file for complete search history.

(56) References Cited

U.S. PATENT DOCUMENTS

| | | | |
|---|---|---|---|
| 1,007,390 | A | 10/1911 | Robinson |
| 1,424,127 | A | 7/1922 | Thole |
| 1,803,612 | A | 5/1931 | Guyer |
| 1,869,751 | A | 8/1932 | Iacobitti |
| 2,285,067 | A | 6/1942 | Thompson |
| 2,362,055 | A | 11/1944 | Densen |
| 2,419,182 | A | 4/1947 | Wells |

(Continued)

FOREIGN PATENT DOCUMENTS

| | | |
|---|---|---|
| WO | 03101842 | 12/2003 |

OTHER PUBLICATIONS

International Application No. PCT/US2015/032668, International Search Report and Written Opinion mailed Aug. 28, 2015, 10 pages.

*Primary Examiner* — Christopher Demeree

(74) *Attorney, Agent, or Firm* — WestRock IP Legal

(57) ABSTRACT

A slide and pour container blank and method of assembly. The initially assembled slide and pour container can be in a sealed state with no access to the interior of the container. A detachable cover can include a tear strip that is removed to provide access to a slidable door. The slidable door can be detached from its guide track and can slide within its guide track. The slidable door can open and block a passageway providing access to the interior of the container, such as to dispense contents of the container.

20 Claims, 4 Drawing Sheets

(56) References Cited

U.S. PATENT DOCUMENTS

| | | | | |
|---|---|---|---|---|
| 2,431,786 | A | 12/1947 | Williamson | |
| 2,507,430 | A | 5/1950 | Yancey | |
| 2,903,175 | A | 9/1959 | Peimer | |
| 2,950,851 | A | 8/1960 | Peimer | |
| 2,975,952 | A | 3/1961 | Tamarin | |
| 3,237,842 | A * | 3/1966 | Esse | B65D 5/541 229/237 |
| 3,887,124 | A | 6/1975 | Skau | |
| 3,971,506 | A * | 7/1976 | Roenna | B65D 5/701 229/234 |
| 4,138,016 | A | 2/1979 | Roccaforte | |
| 4,141,485 | A | 2/1979 | Lambert | |
| 4,197,985 | A | 4/1980 | Austin | |
| 4,609,142 | A | 9/1986 | Adamek | |
| 5,056,708 | A | 10/1991 | Boyle et al. | |
| 5,383,556 | A | 1/1995 | Van Loo | |
| 7,503,475 | B2 | 3/2009 | McGowan | |

* cited by examiner

SLIDE AND POUR CONTAINER

CROSS REFERENCE TO RELATED APPLICATIONS

The present application claims the benefit of U.S. Provisional Application No. 62/003,630, filed on May 28, 2014, entitled "SLIDE AND POUR CONTAINER," which is hereby incorporated by reference in its entirety.

TECHNICAL FIELD

The present disclosure relates to paperboard structures generally and more specifically to paperboard structures that assemble into dispensing containers.

BACKGROUND

A dispensing container can be made from a paperboard blank that is folded into the assembled container.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Embodiments of the present invention include a slide and pour container blank and method of assembly into an erected slide and pour container. The initially assembled slide and pour container can be in a sealed state with no access to the interior of the container. A detachable cover can be removed to provide access to a slidable door. The slidable door can be detached from its guide track and can slide within its guide track. The slidable door can open and block a passageway providing access to the interior of the container, such as to dispense contents of the container.

BRIEF DESCRIPTION OF THE DRAWINGS

The specification makes reference to the following appended figures, in which use of like reference numerals in different figures is intended to illustrate like or analogous components.

DETAILED DESCRIPTION

A slide and pour container blank and method of assembly is disclosed herein. The initially assembled slide and pour container can be in a sealed state where access to the interior of the container is restricted. A detachable cover can be removed to provide access to a slidable door. When detached from its guide track, the slideable door can slide within its guide track to selectively block a passageway providing access to the interior of the container, such as to dispense contents of the container.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

Figure 1:
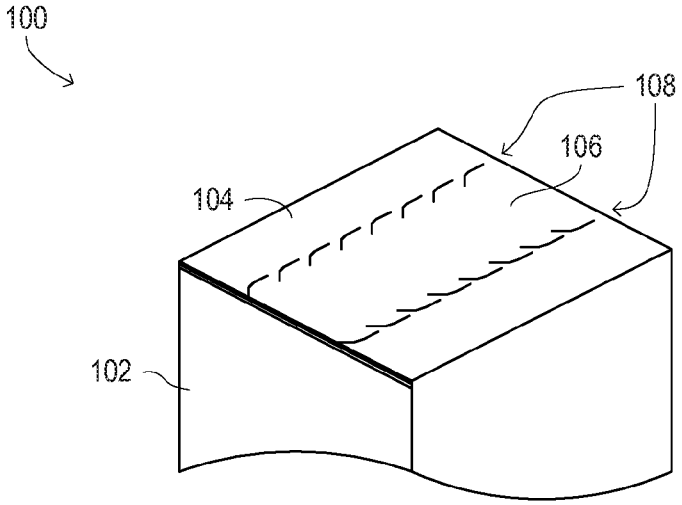
FIG. 1 is an axonometric projection of a portion of a slide and pour container in a sealed configuration according to one embodiment.

FIG. 1 is an axonometric projection of a portion of a slide and pour container 100 in an assembled configuration that is a sealed configuration according to one embodiment. The slide and pour container 100 includes a sidewall 102. The top of the slide and pour container 100 is closed by a cover panel 104. The cover panel 104 includes a detachable cover 106 that limits access to the door access panel 110 underneath. Specifically, the detachable cover 106 can comprise a tear strip formed by two perforation lines 108 along a width of the cover panel 104. Removal of the detachable cover 106, such as ripping off the tear strip, allows access to the door access panel 110 underneath the cover panel 104. In alternate embodiments, the cover panel 104 can include detachable covers 106 that are other suitable devices for creating a detachable seal. The detachable cover 106 can be a detachable material such as a plastic or a metal film that is physically removable from the cover panel 104. In some embodiments, a portion of the detachable cover 106 remains attached to the cover panel 104. In all embodiments, the detachable cover 106 is able to detach sufficiently to allow access to the door access panel 110 underneath the cover panel 104. In the sealed configuration, the detachable cover 106 limits access to the door access panel 110.

Figure 2:
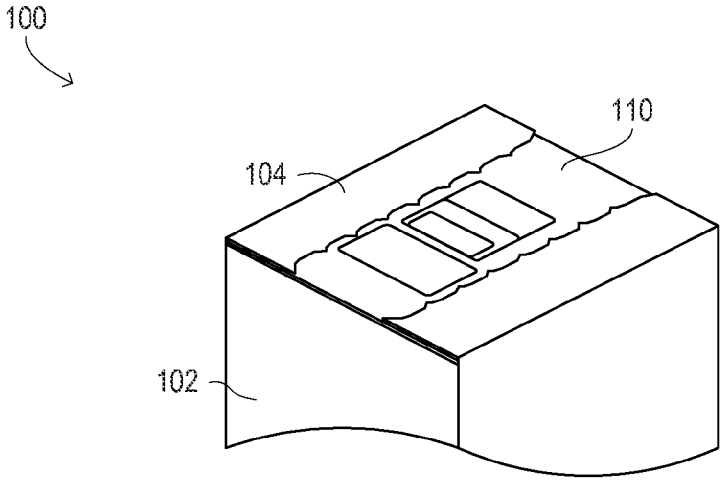
FIG. 2 is an axonometric projection of a portion of the slide and pour container of FIG. 1 in an unsealed configuration according to one embodiment.

FIG. 2 is an axonometric projection of a portion of the slide and pour container 100 of FIG. 1 in an assembled configuration that is an unsealed configuration according to one embodiment. In an unsealed configuration, the detachable cover 106 is detached sufficiently to allow access to the door access panel 110. In some embodiments, the detachable cover 106 is fully detached from the cover panel 104. As seen in FIG. 2, the detachable cover 106 is fully removed from the cover panel 104. With the detachable cover 106 removed, the door access panel 110 is now accessible.

Figure 3:
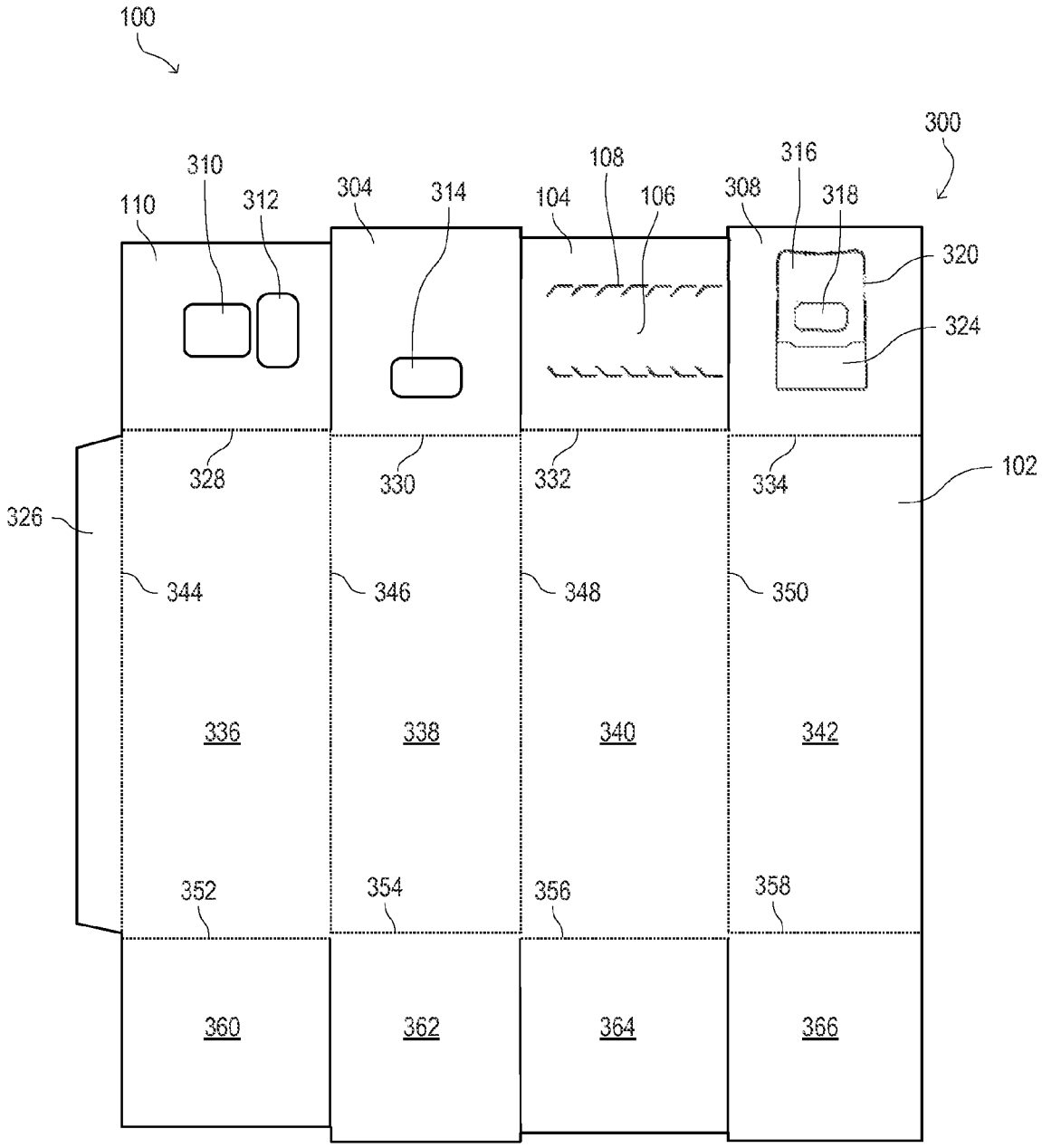
FIG. 3 is a blank from which a slide and pour container may be erected according to one embodiment.

FIG. 3 illustrates a blank 300 from which a slide and pour container 100 can be erected into an unassembled configuration according to one embodiment. The blank illustrated herein is formed from foldable substrates, which may be paper-based material such as paperboard or corrugated sheet material, although other materials may be used if desired. The blanks may be formed from virgin or recycled material, may be coated or uncoated, and may be single-ply or laminated paperboard. Unless otherwise stated, within the borders of an illustration of a blank, broken or dotted lines indicate fold lines, score lines, perforation lines, or other lines of weakness, while solid lines indicate cuts or apertures. The paperboard blank 300 includes a sidewall 102 comprising a first side panel 336, a second side panel 338, a third side panel 340 and a fourth side panel 342. In alternate embodiments, the sidewall 102 can consist of more or fewer side panels, depending on the number of desired sides of the resultant slide and pour container 100, such as three side panels for a container with a triangular cross section, one side panel for a container with a circular cross section, or six side panels for a container with a hexagonal cross section. The shape of each side panel of the sidewall 102 can be adjusted to a desired length and width in order to result in a container with a desired height, width, and depth. Changes to the width (left to right as seen in FIG. 3) or length (top to bottom as seen in FIG. 3) of any side panel will determine the width of any other panel attached thereto.

The first side panel 336 can include a tab 326. The sidewall 102 can be assembled by folding a first sidewall fold 344 by 90°, folding a second sidewall fold 346 by 90°, folding a third sidewall fold 348 by 90°, and folding a fourth sidewall fold 350 by 90°. The tab 326 can be placed adjacent the fourth side panel 342 and attached to the fourth side panel 342 by adhesion or any other suitable attachment mechanism. In some embodiments, the tab 326 can mechanically attach to the fourth side panel 342, such as through interlocking tabs and slots, or other mechanical attachment mechanisms.

The cover panel 104 is coupled to the sidewall 102, such as at the third side panel 340. As used herein, a first element "coupled" to a second element can include the first element that has been contiguously formed from the same piece of material as the second element, as well as a first element that has been otherwise attached to the second element, such as through adhesion. The cover panel 104 can be foldably coupled to the sidewall 102 at a cover panel fold line 332. The detachable cover 106 is coupled to the cover panel 104.

The door access panel 110 is coupled to the sidewall 102, such as at the first side panel 336. The door access panel 110 includes an access opening 310 and a second spout opening 312. The door access panel 110 can be foldably coupled to the sidewall 102 at a door access panel fold line 328.

A spout panel 304 is coupled to the sidewall 102, such as at the second side panel 338. The spout panel 304 includes a first spout opening 314. The first spout opening 314 can be shaped and sized to allow dispensing of the desired product. The second spout opening 312 is approximately the same shape and size as the first spout opening 314. The second spout opening 312 and first spout opening 314 are positioned to align when the paperboard blank 300 is erected into an assembled carton. The spout panel 304 can be foldably coupled to the sidewall 102 at a spout panel fold line 330.

A door panel 308 is coupled to the sidewall 102, such as at the fourth side panel 342. The door panel 308 includes a door 316 and a door track opening 324. The door track opening 324 is an opening within which the door 316 can slide. The door 316 can be removably coupled to the door panel 308 by a door perforation line 320. The door 316 can be separated from the door panel 308 when the paperboard blank 300 is in an assembled configuration, such as by an end user. In alternate embodiments, the door 316 can be coupled to the door panel 308 by other attachment mechanisms. In further alternate embodiments, the door 316 may be not coupled to the door panel 308. The door panel 308 can be made of a material different than the paperboard blank 300. The door 316 can include a grip 318. In some embodiments, the grip 318 is an opening in the door 316 into which a digit can be placed for manipulation of the door 316. In alternate embodiments, the grip 318 can be a textured portion of the door 316 or a material provided on the door 316 that provides enhanced grip to an end user. In alternate embodiments, the door 316 is provided without a grip 318. The door panel 308 can be foldably coupled to the sidewall 102 at a door panel fold line 334.

When the paperboard blank 300 is assembled into an erected carton, the cover panel 104 is located above the door access panel 110, which in turn is located above the door panel 308, which in turn is located above the spout panel 304. When in a sealed configuration, the detachable cover 106 limits access to the door access panel 110, specifically to the access opening 310 and the second spout opening 312. When in an unsealed configuration, the detachable cover 106 is sufficiently detached to provide access to the access opening 310 and the second spout opening 312. The door 316 is retained within the door track opening 324 and between the spout panel 304 and the door access panel 110. The door 316 can be seen and manipulated through the access opening 310. The door 316 is slidable within the door track opening 324 between a closed position and an open position. In a closed position, the door 316 occludes the first spout opening 314 and the second spout opening 312, thus substantially limiting access to the inside of the slide and pour container 100. In a closed position, no contents of the slide and pour container 100 can be dispensed through the first spout opening 314. In an open position, the door 316 does not occlude the first spout opening 314 and the second spout opening 312, thus allowing access to the inside of the slide and pour container 100. In an open position, contents of the slide and pour container 100 can be dispensed through the first spout opening 314.

The paperboard blank 300 can further include a first bottom panel 360, a second bottom panel 362, a third bottom panel 364, and a fourth bottom panel 366. In an assembled configuration, the first bottom panel 360, second bottom panel 362, third bottom panel 364, and fourth bottom panel 366 form a sealed bottom of the slide and pour container 100.

Figure 4:
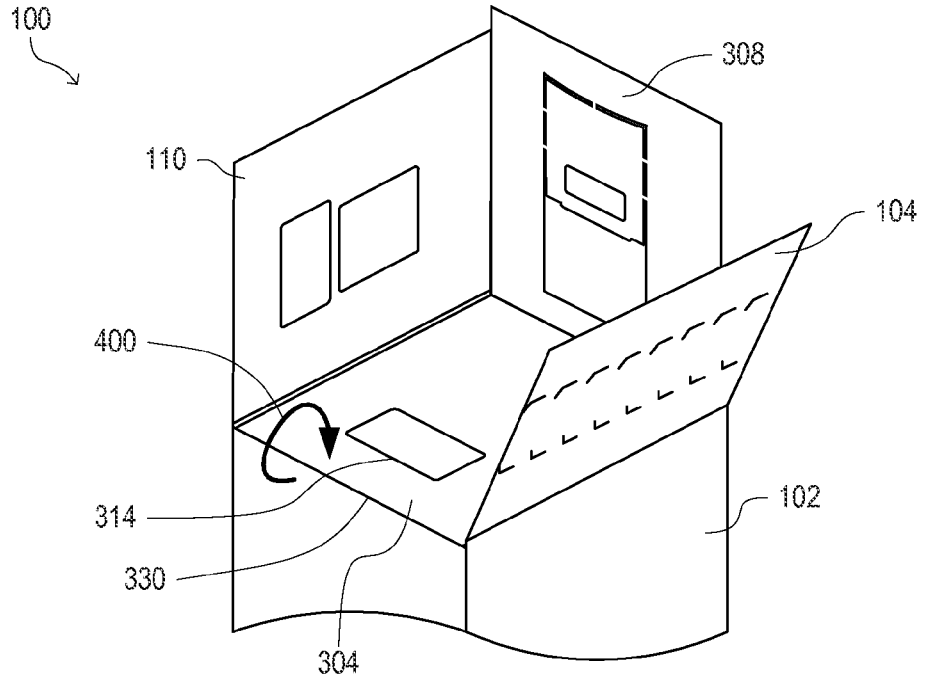
FIG. 4 is an axonometric projection of a portion of the erected slide and pour container of FIG. 3 illustrating a spout panel fold according to one embodiment.

FIG. 4 is an axonometric projection of a portion of the slide and pour container erected from the blank of FIG. 3 illustrating a spout panel fold 400 according to one embodiment. The spout panel 304 folds along the spout panel fold line 330 in an inward direction toward the inside of the sidewall 102.

Figure 5:
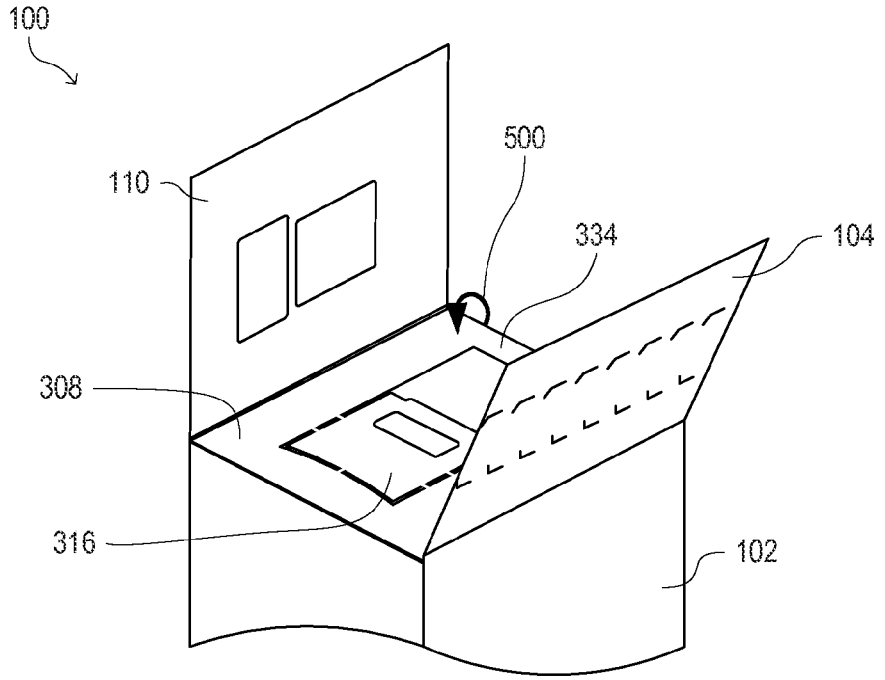
FIG. 5 is an axonometric projection of a portion of the erected slide and pour container of FIG. 3 illustrating a door panel fold according to one embodiment.

FIG. 5 is an axonometric projection of a portion of the slide and pour container erected from the blank of FIG. 3 illustrating a door panel fold 500 according to one embodiment. The door panel 308 folds along the door panel fold line 334 in an inward direction on top of the spout panel 304. When the carton is erected, the door 316 occludes the first spout opening 314. The door panel 308 can be attached to the spout panel 304, such as through application of an adhesive.

Figure 6:
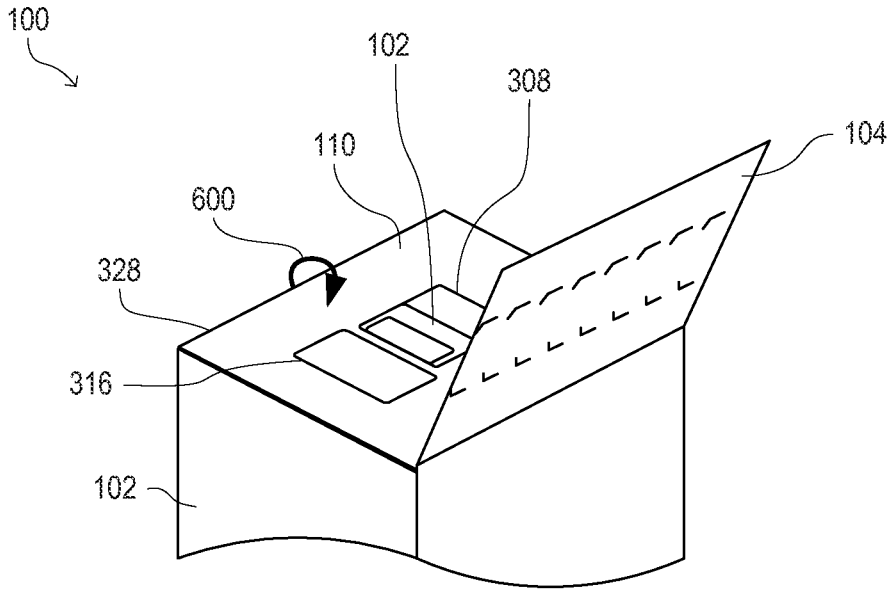
FIG. 6 is an axonometric projection of a portion of the erected slide and pour container of FIG. 3 illustrating a door access panel fold according to one embodiment.

FIG. 6 is an axonometric projection of a portion of the slide and pour container erected from the blank of FIG. 3 illustrating a door access panel fold 600 according to one embodiment. The door access panel 110 folds along the door access panel fold line 328 in an inward direction on top of the door panel 308. The access opening 310 provides access to the door 316. When the carton is erected, the second spout opening 312 aligns with the first spout opening 314. The door access panel 110 can be attached to the door panel 308, such as through application of an adhesive.

Figure 7:
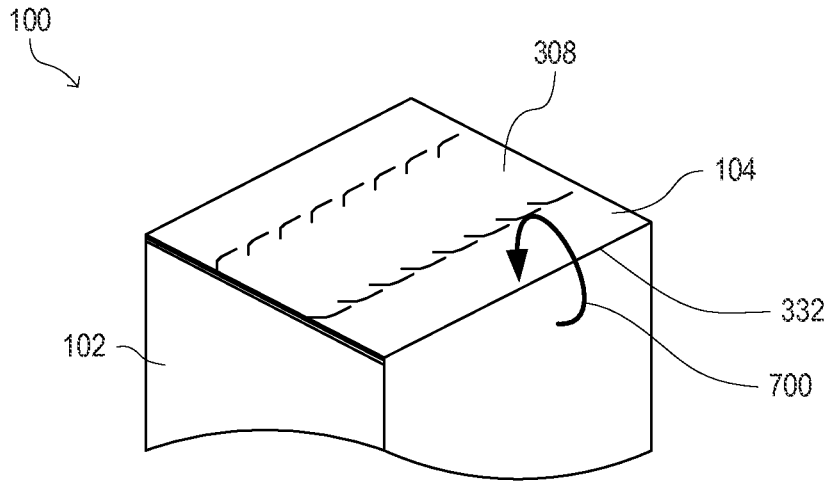
FIG. 7 is an axonometric projection of a portion of the erected slide and pour container of FIG. 3 illustrating a cover panel fold according to one embodiment.

FIG. 7 is an axonometric projection of a portion of the slide and pour container erected from the blank of FIG. 3 illustrating a cover panel fold 700 according to one embodiment. The cover panel 104 folds along the cover panel fold line 332 in an inward direction on top of the door access panel 110. The detachable cover 106 limits access to the access opening 310, and thus limits access to the door 316. The cover panel 104 can be attached, or sealed, to the door access panel 110, such as through application of an adhesive. When the cover panel 104 is attached or sealed to the door access panel 110, the cover panel 104 provides a tamper-resistant seal to the inside of the slide and pour container 100, only accessible after the detachable cover 106 has been detached. Because the detachable cover 106 must be detached in order to access the interior of the slide and pour container 100, detachable cover serves as a tamper proof indication and a user is able to determine whether the interior of the slide and pour container 100 has been accessed.

The sizes and proportions of all openings and panels can be adjusted as desired. Larger panels and openings can be used for dispensing larger objects. Smaller panels and openings can be used for dispensing smaller objects.

The disclosed slide and pour container 100 can be formed from a single paperboard blank 300 with pre-scored fold lines for easy and rapid assembly. In some embodiments, pre-applied adhesive strips can be positioned on the paperboard blank 300 at desired locations for easy and rapid assembly without the need for additional adhesives. The pre-applied adhesive strips can be of any suitable size and shape, including circular, and can be "peel-and-stick" type adhesive strips.

The spout panel 304, door panel 308, door access panel 110, and cover panel 104 collectively form a container opening that can be applied to various types and sizes of containers.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a paperboard blank comprising a sidewall; a spout panel foldably coupled to the sidewall and having a first spout opening; a door panel foldably coupled to the sidewall and having a door and a door track opening, wherein the door is positioned within the door track opening and slidable between a closed position occluding the first spout opening and an open position not occluding the first spout opening when the paperboard blank is in an assembled configuration; a door access panel foldably coupled to the sidewall and having an access opening and a second spout opening, wherein the access opening is positioned to retain the door within the door track opening and provide access to the door when the paperboard blank is in the assembled configuration and wherein the second spout opening aligns with the first spout opening when the paperboard blank is in the assembled configuration; and a cover panel foldably coupled to the sidewall and having a detachable cover, wherein the cover panel is sealable to the door access panel with the detachable cover restricting access to the door when the paperboard blank is in the assembled configuration.

Example 2 is the paperboard blank of example 1, wherein the door is coupled to the door panel.

Example 3 is the paperboard blank of example 1, wherein the door is not coupled to the door panel.

Example 4 is the paperboard blank of examples 1-3, wherein the detachable cover is a tear strip.

Example 5 is the paperboard blank of examples 1-4. wherein the sidewall consists of a first side panel adjacent a second side panel, which is adjacent a third side panel, which is adjacent a fourth side panel.

Example 6 is the paperboard blank of example 5, wherein the door access panel is foldably coupled to the first side panel, the spout panel is foldably coupled to the second side panel, the cover panel is foldably coupled to the third side panel, and the door panel is foldably coupled to the fourth side panel.

Example 7 is the paperboard blank of examples 1-6, additionally comprising pre-applied adhesive strips.

Example 8 is a method of assembling a slide and pour container, comprising folding a sidewall of a paperboard blank into a structure having an interior, wherein the paperboard blank includes a spout panel, a door panel, a door access panel, and a cover panel coupled to the sidewall; folding the spout panel along a spout panel fold line towards the interior, wherein the spout panel includes a first spout opening; folding the door panel along a door panel fold line on top of the spout panel, wherein the door panel includes a door and a door track opening and wherein the door is positioned within the door track opening and slidable between a closed position occluding the first spout opening and an open position not occluding the first spout opening when the paperboard blank is in an assembled configuration; folding the door access panel on top of the door panel, wherein the door access panel includes an access opening and a second spout opening, wherein the access opening is positioned to retain the door within the door track opening and provide access to the door when the paperboard blank is in the assembled configuration and wherein the second spout opening aligns with the first spout opening when the paperboard blank is in the assembled configuration; folding the cover panel on top of the door access panel, wherein the cover panel includes a detachable cover positioned to restrict access to the interior when the paperboard blank is in the assembled configuration; and sealing the cover panel on top of the door access panel.

Example 9 is the method of example 8, additionally comprising attaching the door panel to the spout panel.

Example 10 is the method of examples 8 or 9, additionally comprising attaching the door access panel to the door panel.

Example 11 is the method of examples 8-10, wherein the door is coupled to the door panel.

Example 12 is the method of examples 8-10, wherein the door is not coupled to the door panel.

Example 13 is the method of examples 8-12, wherein folding the sidewall includes positioning the spout panel opposite the door panel.

Example 14 is the method of examples 8-13, wherein folding the sidewall includes positioning the door access panel opposite the cover panel.

Example 15 is a container end assembly comprising a spout panel positioned adjacent an interior of a container, the spout panel having a first spout opening; a door panel positioned opposite the spout panel from the interior of the container, the door panel including a door and a door track opening, wherein the door is positioned within the door track opening and slidable between a closed position occluding the first spout opening and an open position not occluding the first spout opening; a door access panel positioned opposite the door panel from the spout panel, the door access panel including an access opening and a second spout opening, wherein the access opening is positioned to retain the door within the door track opening and provide access to the door and wherein the second spout opening aligns with the first spout opening; and a cover panel adhesively attached to the door access panel opposite the door panel, the cover panel including a detachable cover restricting access to the door.

Example 16 is the container end assembly of example 15, wherein the door is coupled to the door panel.

Example 17 is the container end assembly of example 15, wherein the door is not coupled to the door panel.

Example 18 is the container end assembly of examples 15-17, wherein the detachable cover is a tear strip.

Example 19 is the container end assembly of examples 15-18, wherein the door panel is adhesively attached to the spout panel.

Example 20 is the container end assembly of examples 15-19, wherein the door access panel is adhesively attached to the door panel.

What is claimed is:

1. A paperboard blank, comprising:

a sidewall;

a spout panel foldably coupled to the sidewall and having a first spout opening;

a door panel foldably coupled to the sidewall and having a door and a door track opening, wherein the door is positioned within the door track opening and slidable between a closed position occluding the first spout opening and an open position not occluding the first spout opening when the paperboard blank is in an assembled configuration;

a door access panel foldably coupled to the sidewall and having an access opening and a second spout opening, wherein the access opening is positioned to retain the door within the door track opening and provide access to the door when the paperboard blank is in the assembled configuration and wherein the second spout opening aligns with the first spout opening when the paperboard blank is in the assembled configuration; and a cover panel foldably coupled to the sidewall and having a detachable cover, wherein the cover panel is sealable to the door access panel with the detachable cover restricting access to the door when the paperboard blank is in the assembled configuration.

2. The paperboard blank of claim 1, wherein the door is coupled to the door panel.

3. The paperboard blank of claim 1, wherein the door is not coupled to the door panel.

4. The paperboard blank of claim 1, wherein the detachable cover is a tear strip.

5. The paperboard blank of claim 1, wherein the sidewall consists of a first side panel adjacent a second side panel, which is adjacent a third side panel, which is adjacent a fourth side panel.

6. The paperboard blank of claim 5, wherein the door access panel is foldably coupled to the first side panel, the spout panel is foldably coupled to the second side panel, the cover panel is foldably coupled to the third side panel, and the door panel is foldably coupled to the fourth side panel.

7. The paperboard blank of claim 1, additionally comprising pre-applied adhesive strips.

8. A method of assembling a slide and pour container, comprising:

folding a sidewall of a paperboard blank into a structure having an interior, wherein the paperboard blank includes a spout panel, a door panel, a door access panel, and a cover panel coupled to the sidewall;

folding the spout panel along a spout panel fold line towards the interior, wherein the spout panel includes a first spout opening;

folding the door panel along a door panel fold line on top of the spout panel, wherein the door panel includes a door and a door track opening and wherein the door is positioned within the door track opening and slidable between a closed position occluding the first spout opening and an open position not occluding the first spout opening when the paperboard blank is in an assembled configuration;

folding the door access panel on top of the door panel, wherein the door access panel includes an access opening and a second spout opening, wherein the access opening is positioned to retain the door within the door track opening and provide access to the door when the paperboard blank is in the assembled configuration and wherein the second spout opening aligns with the first spout opening when the paperboard blank is in the assembled configuration;

folding the cover panel on top of the door access panel, wherein the cover panel includes a detachable cover positioned to restrict access to the interior when the paperboard blank is in the assembled configuration; and sealing the cover panel on top of the door access panel.

9. The method of claim 8, additionally comprising attaching the door panel to the spout panel.

10. The method of claim 8, additionally comprising attaching the door access panel to the door panel.

11. The method of claim 8, wherein the door is coupled to the door panel.

12. The method of claim 8, wherein the door is not coupled to the door panel.

13. The method of claim 8, wherein folding the sidewall includes positioning the spout panel opposite the door panel.

14. The method of claim 8, wherein folding the sidewall includes positioning the door access panel opposite the cover panel.

15. A container end assembly, comprising:

a spout panel positioned adjacent an interior of a container, the spout panel having a first spout opening;

a door panel positioned opposite the spout panel from the interior of the container, the door panel including a door and a door track opening, wherein the door is positioned within the door track opening and slidable between a closed position occluding the first spout opening and an open position not occluding the first spout opening;

a door access panel positioned opposite the door panel from the spout panel, the door access panel including an access opening and a second spout opening, wherein the access opening is positioned to retain the door within the door track opening and provide access to the door and wherein the second spout opening aligns with the first spout opening; and a cover panel adhesively attached to the door access panel opposite the door panel, the cover panel including a detachable cover restricting access to the door.

16. The container end assembly of claim 15, wherein the door is coupled to the door panel.

17. The container end assembly of claim 15, wherein the door is not coupled to the door panel.

18. The container end assembly of claim 15, wherein the detachable cover is a tear strip.

19. The container end assembly of claim 15, wherein the door panel is adhesively attached to the spout panel.

20. The container end assembly of claim 15, wherein the door access panel is adhesively attached to the door panel.

* * * * *